US005495327A

United States Patent [19]

Inomata

[11] Patent Number: 5,495,327

[45] Date of Patent: Feb. 27, 1996

[54] IMAGE FORMING APPARATUS

[75] Inventor: Mitsugu Inomata, Kawasaki, Japan

[73] Assignee: Canon Kabushiki Kaisha, Tokyo, Japan

[21] Appl. No.: 281,115

[22] Filed: Jul. 27, 1994

Related U.S. Application Data

[63] Continuation of Ser. No. 866,463, Apr. 10, 1992, abandoned.

[30] Foreign Application Priority Data

| | | | |
|---|---|---|---|
| Apr. 15, 1991 | [JP] | Japan | 3-108346 |
| May 10, 1991 | [JP] | Japan | 3-133352 |
| Apr. 3, 1992 | [JP] | Japan | 4-082194 |

[51] Int. Cl.[6] ..... G03G 15/01

[52] U.S. Cl. ..... 355/326 R; 355/210; 355/245

[58] Field of Search ..... 118/645; 346/157; 355/245, 200, 210, 211, 212, 326 R, 327, 328

[56] References Cited

U.S. PATENT DOCUMENTS

| | | | |
|---|---|---|---|
| 4,996,566 | 2/1991 | Morita et al. | 355/246 |
| 5,103,764 | 4/1992 | Fujieara et al. | 118/645 |
| 5,162,821 | 11/1992 | Fukuchi et al. . | |
| 5,168,319 | 12/1992 | Kimura et al. | 355/326 R |

FOREIGN PATENT DOCUMENTS

| | | | |
|---|---|---|---|
| 326941 | 8/1989 | European Pat. Off. . | |
| 410730 | 1/1991 | European Pat. Off. . | |
| 411825 | 2/1991 | European Pat. Off. . | |
| 4731182 | 3/1992 | European Pat. Off. . | |
| 62-121473 | 6/1987 | Japan . | |
| 64-971 | 1/1989 | Japan . | |
| 3-137659 | 6/1991 | Japan | 355/326 R |

*Primary Examiner*—Benjamin R. Fuller
*Assistant Examiner*—John E. Barlow, Jr.
*Attorney, Agent, or Firm*—Fitzpatrick, Cella, Harper & Scinto

[57] ABSTRACT

The present invention relates to an image forming apparatus for forming an image on a recording medium, comprising an image bearing member, plural development means for effecting image development by acting on said image bearing member, and drive means for enabling drive force transmission to selected one among said plural development means by rotation in a direction, and driving said selected development means by rotation in a direction opposite to the above-mentioned direction.

22 Claims, 12 Drawing Sheets

IMAGE FORMING APPARATUS

This application is a continuation of application Ser. No. 07/866,463 filed Apr. 10, 1992, now abandoned.

BACKGROUND OF THE INVENTION

1. Field of the Invention

The present invention relates to an image forming apparatus for forming an image on a recording medium, such as electrophotographic copying apparatus, laser beam printer (LBP), facsimile apparatus, word processor or the like.

2. Related Background Art

In an image forming apparatus in which plural developing units respectively containing toners of different colors are positioned along a running image bearing member and are activated in succession to form a color toner image, it is conceived to equip the developing units respectively with solenoid clutches and to activate said developing units in succession by on-off operations of said solenoid clutches. In such operating system, there is required a solenoid clutch for each developing unit. Thus, in case of forming a full color image with toners of four colors of cyan, magenta, yellow and black, there are required four developing units, or namely four solenoid clutches. Since such solenoid clutches are expensive, such system leads to an increased cost of the entire apparatus.

Also since the solenoid clutches are relatively bulky, there is required a large space for the installation thereof.

On the other hand, in the conventional technology, since the developing units are positioned inside the apparatus, it is difficult for the operator to judge whether the selected developing unit is properly functioning.

Therefore, in case of eventual defect in the image, it is difficult for the operator to judge whether such defect is induced by the improper function of the developing units.

In the conventional technology employing mechanical switch means composed of gears and cams for transmitting the driving force, a shift gear has to be moved between a released position and an engaging position by cam member. However, if the cam groove of the cam member is displaced from the desired position of the shift gear, it cannot move to the engaging position so that the latent image formed on the photosensitive drum cannot be developed in a visible toner image by a desired developing unit. In such case, the operator can know the absence of transfer of a toner image of a certain color only by observing the recording sheet discharged from the apparatus, and has to repeat the image forming operation from the beginning. This fact results in a significantly deteriorated work efficiency.

SUMMARY OF THE INVENTION

In consideration of the foregoing, an object of the present invention is to provide an image forming apparatus enabling compactization.

Another object of the present invention is to provide an image forming apparatus enabling a reduction in the manufacturing cost.

Still another object of the present invention is to provide an image forming apparatus capable of transmitting the driving force to developing means selected from plural ones, with a smaller space of installation than in the conventional technology.

Still another object of the present invention is to provide an image forming apparatus employing a single driving source and capable of connecting developing means selected from plural ones with said driving source through a driving force transmitting path and driving said selected developing means.

Still another object of the present invention is to provide an image forming apparatus enabling to judge a defective function if it occurs in the selected developing means.

Still another object of the present invention is to provide an image forming apparatus in which a process cartridge, integrally incorporating an image bearing member and plural developing means, can be detachably mounted.

Still another object of the present invention is to provide an image forming apparatus provided with plural developing units which are positioned opposed to an image bearing member and can be selectively activated, said apparatus comprising switch means provided between a driving source and the developing units for rendering one of said developing units operable, and transmission means for selecting a developing unit to be activated by said switch means in response to the rotation in a direction by said driving source and operating said developing unit in response to the rotation in the other direction.

Still another object of the present invention is to provide a multi-color image forming apparatus provided with driving force transmission/switch means which, in selecting desired developing means among plural ones provided in a process cartridge and forming an image of a selected color by said selected developing means, is adapted to transmit the driving force from the main body of the apparatus to said desired developing means, thereby mechanically selecting the developing means.

Still another object of the present invention is to provide a multi-color image forming apparatus enabling, in case of selecting and driving desired developing means from plural ones by the mechanical driving force transmission/switch means, to immediately judge whether said selected developing means is operated or not.

DETAILED DESCRIPTION OF THE PREFERRED EMBODIMENTS

Now the present invention will be clarified in detail by preferred embodiments thereof.

In the following there will be described an image forming apparatus provided with a driving motor, plural development units selectively driven by said motor and a switching cam mechanism for driving a selected development unit, and allowing switched drive of the plural development units with a simple and inexpensive configuration employing only one motor, by providing a transmission mechanism capable of transmitting rotation of one direction only between said motor and said switching cam mechanism and a transmission mechanism capable of transmitting rotation of the other direction only between said motor and selected development unit. This embodiment allows to securely control the selection of the development unit and the function thereof by simple mechanical means, without the use of expensive components such as solenoid clutch. More specifically a driving motor can be used for selecting the development unit, driving the selected development unit, and driving an image bearing member such as a photosensitive drum.

Figure 1:
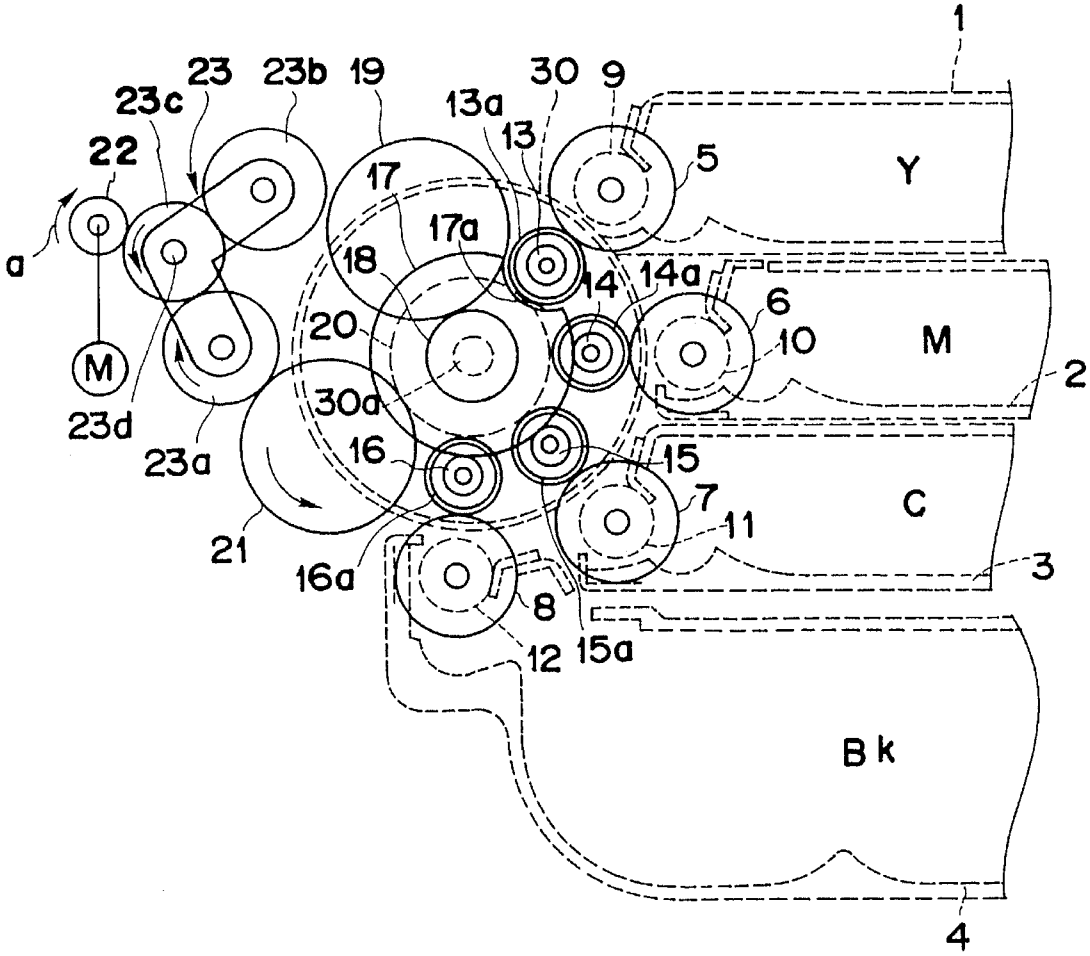
FIG. 1 is a lateral view of a drive transmission switching mechanism for developing units, embodying the present invention.

FIG. 1 is a schematic lateral view of a preferred embodiment of the present invention, in which, for ease of understanding, the development units and the image bearing member are illustrated by double-dotted chain lines.

In the illustrated apparatus, there are provided four development units containing cyan (C), magenta (M), yellow (Y) and black (K) toners which are numbered 3, 2, 1 and 4, respectively. In each image development, one of said development units is activated corresponding to a latent image formed on an image bearing member 30, and a developing roller (9, 10, 11 or 12) provided in said development unit supplies toner to form a toner image. Means for forming said latent image will be explained later.

Figure 2:
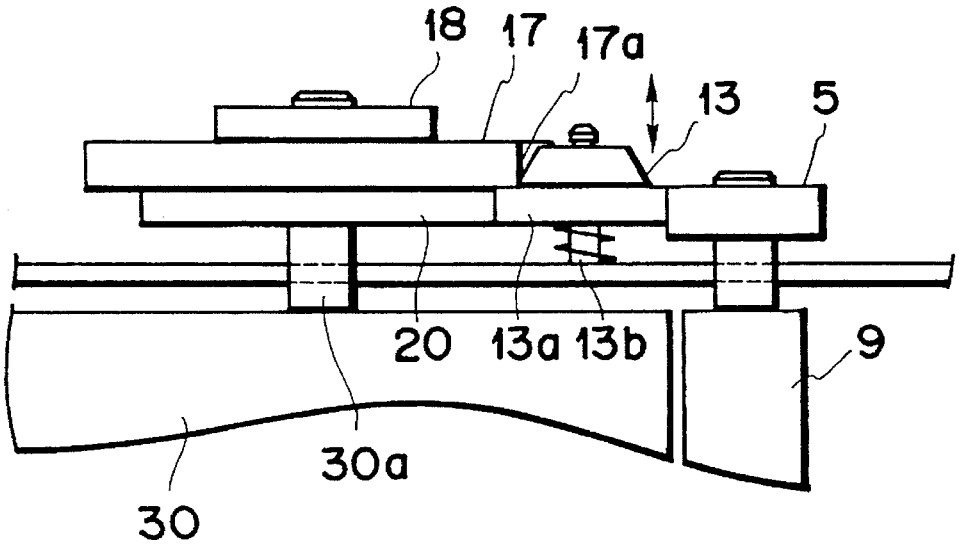
FIGS. 2 and 3 are partial lateral views of a selecting mechanism for developing units, constituting an embodiment of the present invention.
Figure 3:
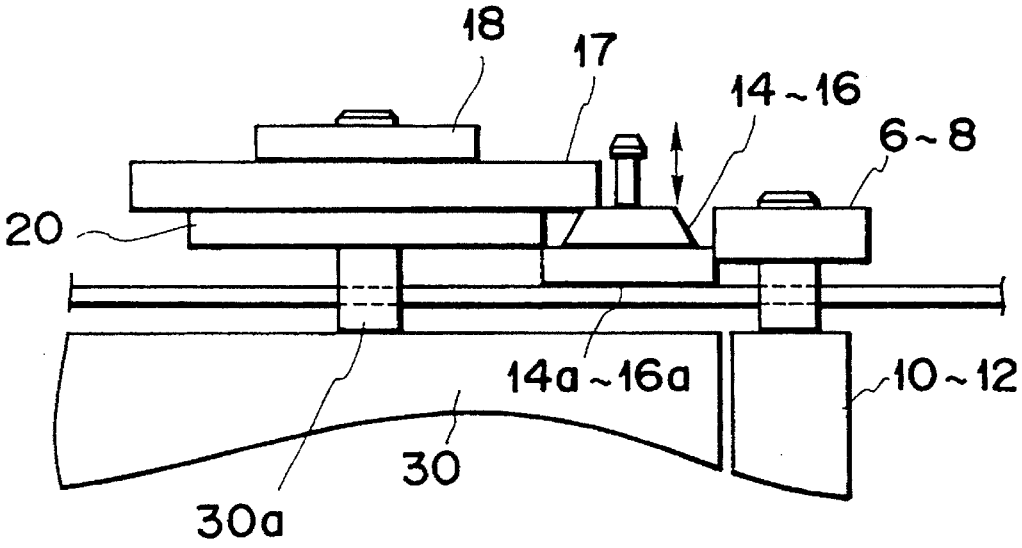

In the following there will be explained the switching of the development units, with reference to FIGS. 1, 2 and 3, in which FIGS. 2 and 3 are lateral views of an end portion of the apparatus shown in FIG. 1.

As shown in these drawings, a cam 17 with a notch 17*a* is rotated by a driving source to be explained later. When a conical portion 13 formed on a gear 13*a* fits into said notch 17*a*, the gear 13*a* meshes, by the pushing force of a spring 13*b*, with a gear 5 which is coaxial with a gear 20 and a developing roller 9. When a gear 22, driven by a motor M (for example a stepping motor) is rotated in a direction a shown in FIG. 1, a switching gear 23*a* supported by a crank-shaped support member 23 assumes the illustrated position, whereby the driving force is transmitted through gears 22, 23*c*, 23*a*, 21, 20, 13*a* and 5 to rotate the developing roller 9 which thus supplies toner to a latent image formed on the image bearing member 30 with a rotating shaft 30*a*. Said crank-shaped support member 23 supports a gear 23*c* at the center and gears 23*a*, 23*b* on both ends which can vibrate vertically about an axis 23*d* coaxial with the gear 23*c*, whereby either gears 21 and 23*a* or gears 19 and 23*b* come into a meshing state.

When the gears 21 and 23*a* are in the mutually meshing state, conical portions 14, 15, 16 of gears 6, 7, 8 coaxial with the driving rollers 10, 11, 12 of other development units 2, 3, 4 are pressed by the cam 17, so that said gears 6, 7, 8 are disconnected from the gear 20 and the developing rollers 10, 11, 12 do not rotate. Also when one of other conical portions 14–16 fits into the notch 17*a* of the cam 17, only one developing roller, driven by one of the gears 14*a*–16*a* fitted into said recess 17*a*, is rotated as explained above, while other three developing rollers are stopped.

In the present embodiment, when the motor M is reversed by a signal from a control unit 100 to be explained later, the gear 22 starts to rotate in a direction opposite to the arrow a shown in FIG. 1, whereby the support member 23 is shifted to disengage the gears 21 and 23*a* and to bring the gears 19 and 23*b* into the mutually meshing state. Then the gear 19 rotates the cam 17 through the gear 18 whereby the notch 17*a* of said cam 17 selectively fits with one of the conical portions, corresponding to the signal from the control unit 100. Thus, by a signal from the control unit 100, the motor M is rotated in a predetermined direction to bring a developing roller to an operable state through the cam 17 and the intermediate gears 13*a*–16*a* provided with conical portions 13–16. More specifically, the gear 20 and the selected one of the gears 14*a*–16*a* are brought into the mutually meshing state, thereby establishing a drive transmission path between the motor M and the selected one of the developing rollers 9–12. Then the motor M is reversed to transmit the driving force thereof to said selected developing roller, thus effecting the development step by rotating said developing roller and the image bearing member 30.

The above-explained operation is repeated for a necessary number of times in response to the signals from the control unit 100. For example, if said signals instruct the formation of a full-color image, said operation is repeated four times, whereby the developing rollers 9–12 rotate in succession to form a full-color image. On the other hand, if said signals indicate the formation of a monochromatic image, there is conducted development of a selected color only.

Figure 4:
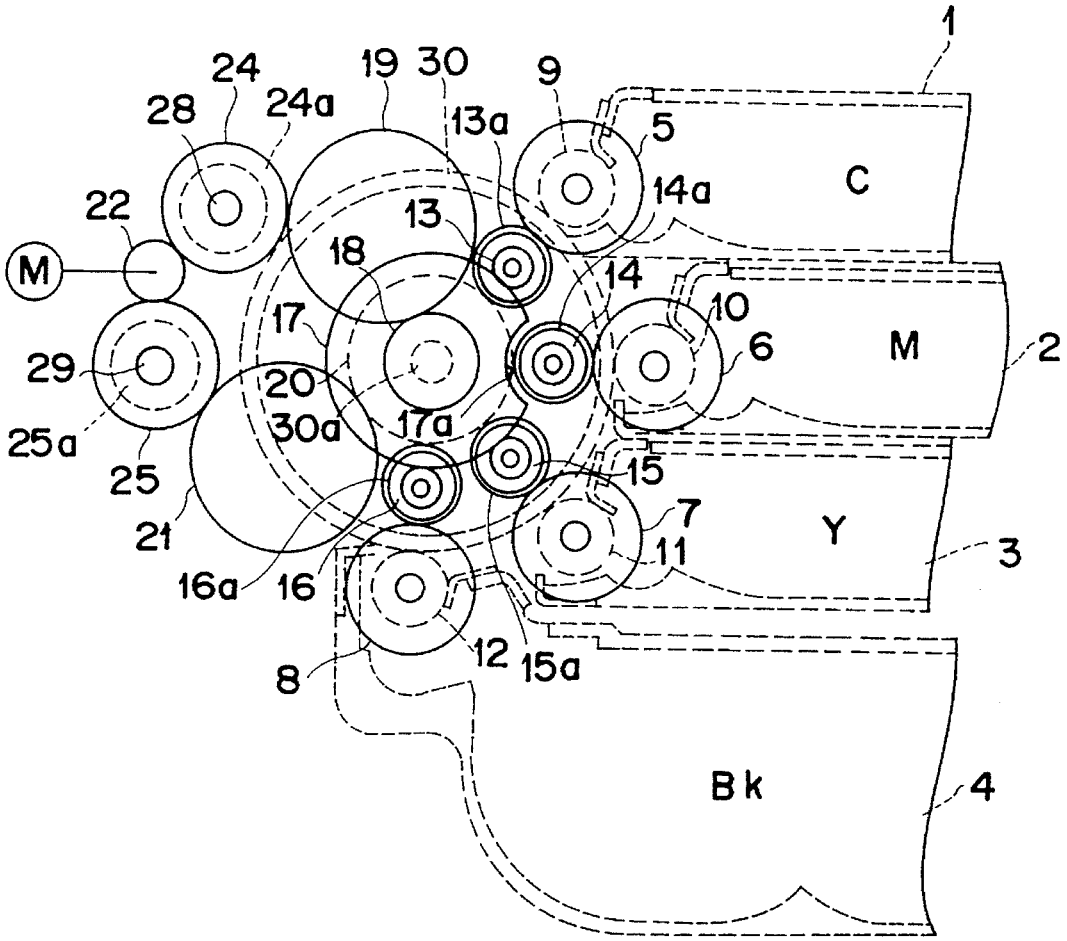
FIG. 4 is a lateral view of a drive transmission switching mechanism for developing units, constituting another embodiment of the present invention.
Figure 5:
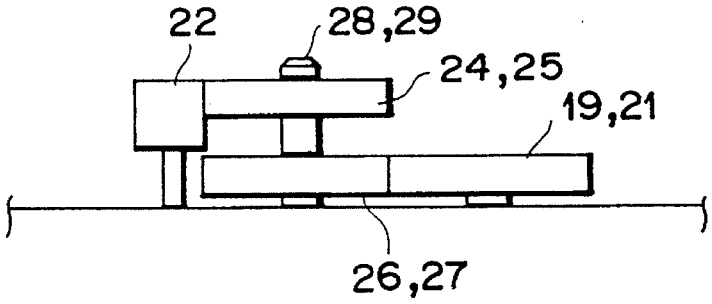
FIG. 5 is a lateral view of a driving gear train.

In the following there will be explained another embodiment of the present invention with reference to FIG. 4, in which components corresponding to those of the foregoing embodiment are represented by same symbols, and will not be explained further.

In the present embodiment, gears 24, 25 respectively provided with one-way clutches 24*a*, 25*a* are provided respectively between the motor gear 22 and the switching gear 19 and between said motor gear 22 and the driving gear 21. Also provided are freely rotatable shafts 28, 29 and gears 26, 27 integrally rotatable with said shafts, and said gears 26, 27 respectively mesh with the gears 19, 20. Also the directions of driving force transmission from the gears 24, 25 to the shafts 28, 29 are mutually opposite. In such configuration, the motor M can select the development units by the cam 17 in the rotation in one direction, and effect the development by driving the developing roller and the image bearing member in the rotation in the other direction.

As explained in the foregoing, the present embodiment is to selectively activate plural development units by utilizing the rotation of a single motor in one direction for the selection of said development units and the rotation in the other direction for the drive of the selected development unit and the image bearing member, in secure manner through an extremely simple mechanical configuration, and such embodiment is evidently effective for reducing the manufacturing cost of the apparatus of this kind.

In the following, with reference to FIGS. 6 to 11, there will be explained still another embodiment of the present invention, which allows to detect the defective drive state of the development means. The configuration for detecting the defective drive state of the development means, to be explained in the following, is applicable also to the foregoing embodiments.

In the following embodiment, there is employed a process cartridge, integrally containing a photosensitive drum, constituting the image bearing member, and plural development units positioned around said photosensitive drum, and detachably mounted in the main body of an image forming apparatus, for formation of a multi-color image.

At first an example of such process cartridge will be explained with reference to FIG. 6, in which, for ease of understanding the cartridge is illustrated by broken lines.

In the process cartridge 102 there is provided a photosensitive drum 103, around which provided are four development units 104A, 104B, 104C, 104D respectively for yellow (Y), magenta (M), cyan (C) and black (Bk) toners, a charging roller 115, a cleaning unit 105 etc. On a shaft 103*a* of said photosensitive drum 103, there is fixed a drum gear 110 for rotating said drum itself and for transmitting the driving force to the development units 104A, 104B, 104C, 104D, and there is rotatably supported a cam gear 111 having a cam member 112 for selecting one of said four development units 104. On an end of the shaft of a developing sleeve 140, constituting a developer bearing member in each development unit 104, there is fixed a driven gear 141. Each of applicator rollers 142 has functions of supplying toner to the developing sleeve 140 and removing the toner remaining on the periphery of the sleeve 140.

Figure 6:
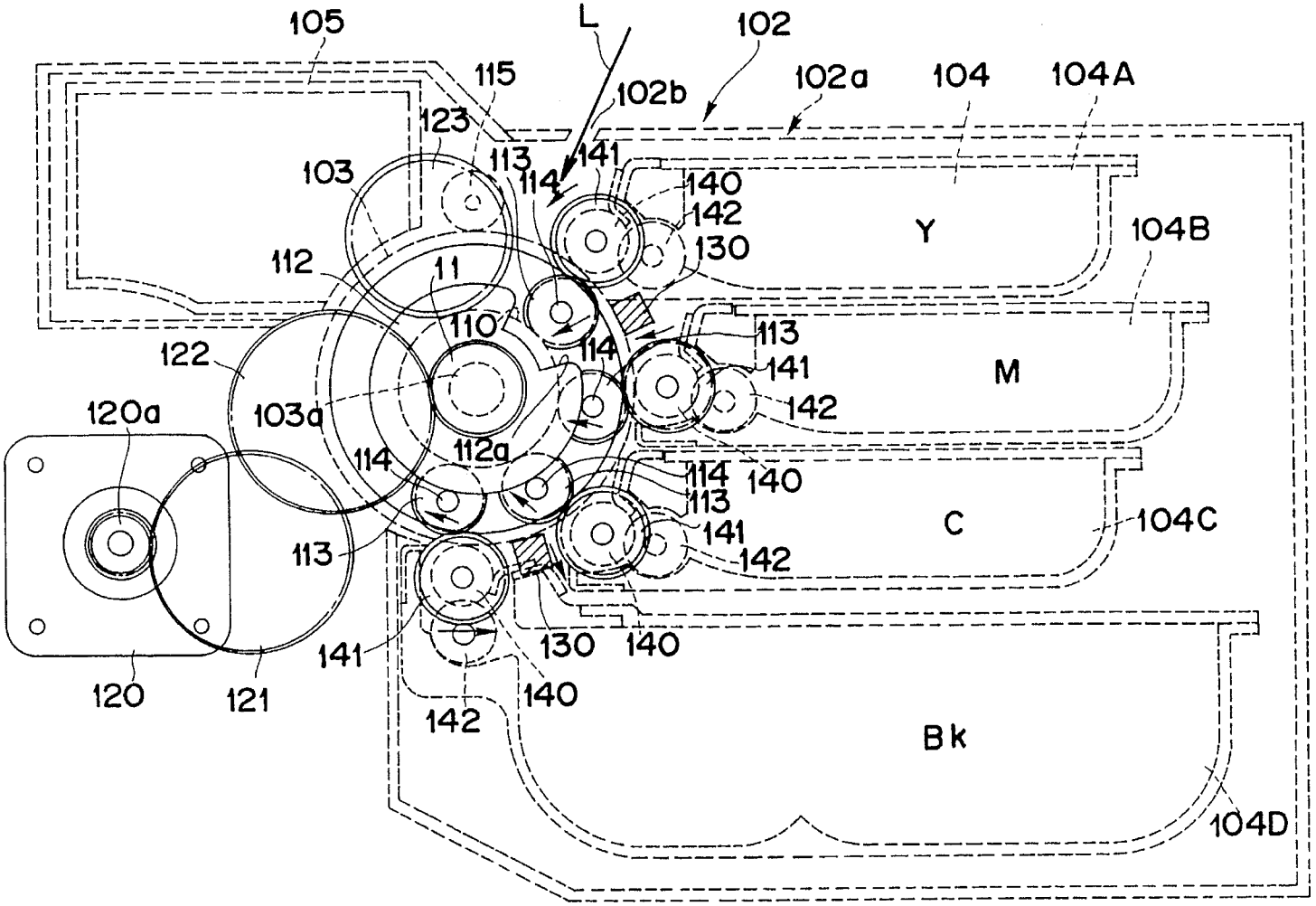
FIG. 6 is a lateral view of a drive transmission switching mechanism around a photosensitive drum in an image forming apparatus, constituting another embodiment of the present invention.
Figure 10:
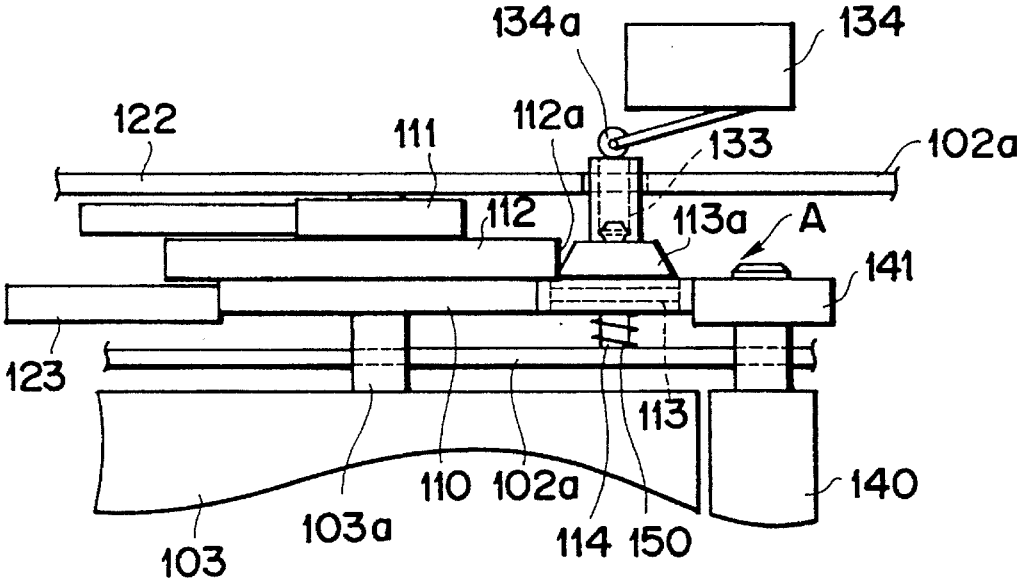
FIG. 10 is a lateral view of detection means, for detecting the driven or undriven state of the developing unit, in an image forming apparatus constituting another embodiment of the present invention.
Figure 11:
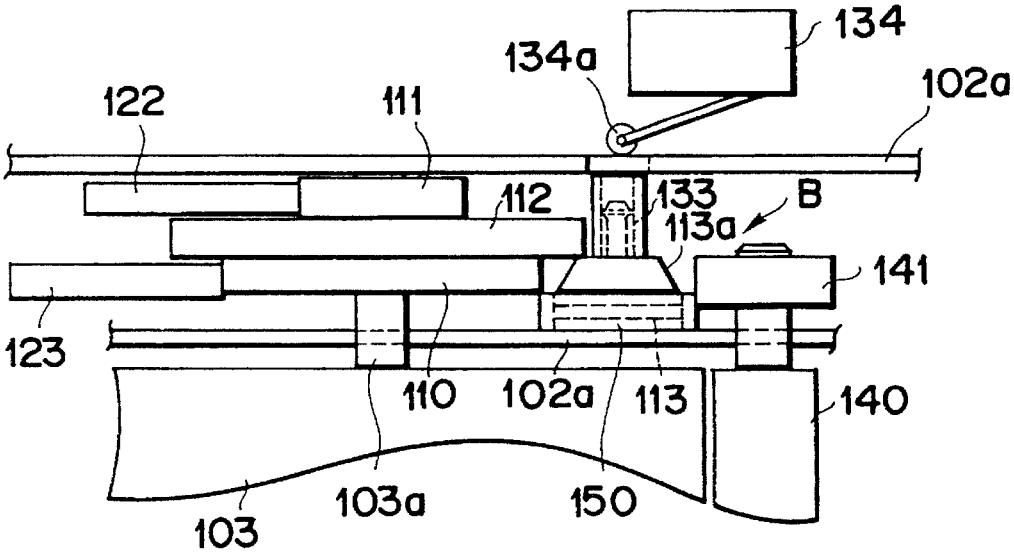
FIG. 11 is a lateral view of the detection means shown in FIG. 10.

Between the drum gear 110 and the driven gears 141, there are provided shift gears 113, respectively corresponding to the development units 104, for selectively transmitting the rotation of said drum gear 110 to the driven gear 141 of a desired development unit 104 (cf. FIGS. 6, 10 and 11). Each of said shift gears 113 is supported, rotatably and axially movably, on a shaft 114 provided on a cartridge frame member 102*a*, and is constantly biased by a spring member 150 to a meshing position A with the drum gear 110 shown in FIG. 10, but three of said shift gears 113 are moved, as shown in FIG. 11, toward the cartridge frame member 102*a* by a cam member 112 engaging with protruding portions 113*a* of said gears and are placed in released position B in which the meshing with the drum gear 110 is released.

Each shift gear 113 remains in the meshing state with the driven gear 141 of the development unit 104, even when it moves vertically along the shaft 114.

In the main body of the apparatus there are provided a development unit switching motor 120, a first gear 121 meshing with a motor gear 120*a* of said switching motor 120, a second gear 122 meshing with the cam gear 111 of the process cartridge 102, and a driving gear 123 meshing with said drum gear 110.

When the process cartridge 102 is mounted in the main body of the apparatus, the second gear 122 meshes with the cam gear 111 while the driving gear 123 meshes with the drum gear 110 whereby the process cartridge is enabled for formation of multi-colored image. Then the photosensitive drum 103, charged by the charging roller 115, is exposed to image light L through an exposure aperture 102*b* formed on a casing 102*a* to form a latent image corresponding to the image information. Then, in response to a signal from the control unit 100, for selecting a development unit 104 of a desired color, for example the yellow development unit 104A, the development unit switching motor 120 is activated to rotate the first and second gears 121, 122 thereby rotating the cam gear 111.

Figure 15:
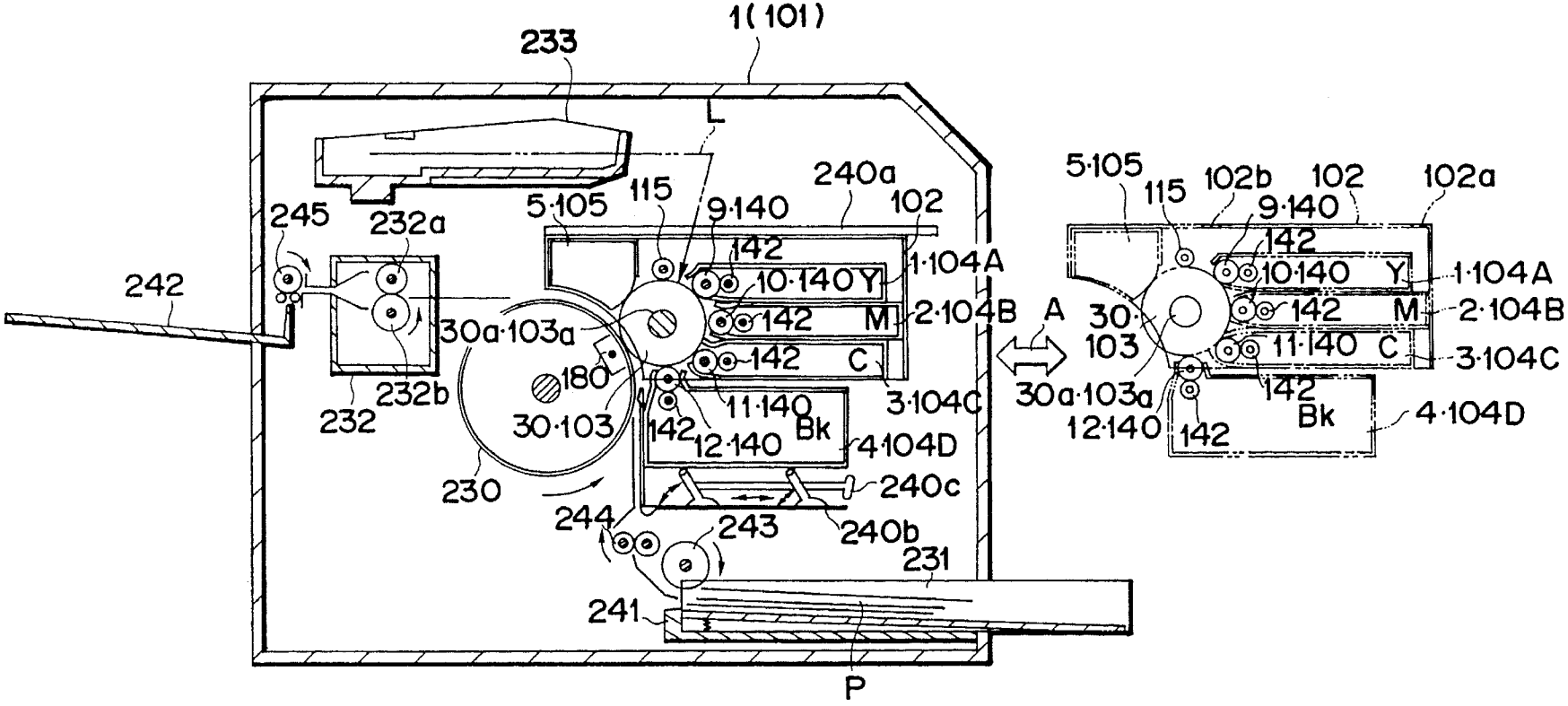
FIG. 15 is a lateral view of an image forming apparatus in which the present invention is applicable.

The cam gear 111 rotates in such a manner as to accommodate the shift gear 113 of the yellow development unit 104A in a cam groove 112*a* of the cam member 112, whereby said shift gear 113 is disengaged from the cam member 112, is lifted from the released position B to the meshing position A and meshes with the drum gear 110 as shown in FIG. 10. Said shift gear 113, rotated by the drum gear 110, rotates the developing sleeve 140 of the yellow development unit 140A through the driven gear 141 thereof. Thus, the latent image moving toward said yellow development unit 104A by the rotation of the photosensitive drum 103 is rendered visible as a toner image, by said unit 104A. Thus obtained toner image is transferred onto a recording sheet (medium) by the function of a transfer charger 180 (FIG. 15). Thereafter similar operations are repeated, and toner images formed by the magenta, cyan and black development units 104B, 104C, 104D are overlappingly transferred on said recording sheet to obtain a full-color image.

In the above-explained configuration for switching the transmission of driving force, including the development unit switching motor 120, first and second gears 121, 122, driving gear 123, cam gear 111 with cam member 112, drum gear 110 and shift gears 113, a desired development unit 104 is selectively driven by the movement of the shift gear 113 between the meshing position and the released position.

In the following there will be explained an embodiment allowing to detect whether the driving force is securely transmitted to selected development means, namely to detect the driven or undriven state of the driven member in the development means switched by the drive transmission switching means.

As explained in the foregoing, the shift gear 113 is moved by the released position B (cf. FIG. 11) by the cam member 112 and normally disengaged from the drum gear 110. The shift gear 113, which drops into the cam groove 102*a* of the cam member 102, is moved to the meshing position A (cf. FIG. 10) by the spring member 115 and meshes with the drum gear 110. The shift gear 113 remains meshing with the driven gear 141 of the development unit 4 in either of the meshing position A and the released position B. On the other hand, in the main body 101 of the apparatus, there are provided the development unit switching motor 120, motor gear 120*a*, first and second gears 121, 122 and driving gear 123.

Thus, while the drive gear 123 rotates the drum gear 110, the development unit switching motor 120 rotates the cam member 112 through the motor gear 120*a*, first and second gears 121, 122 and cam gear 111. Then, the shift gear 113 of a development unit, selected according to the selection signal from the control unit 100, is made to drop into the cam groove 112*a* of the cam member 112 and said shift gear 113 is driven by the drum gear 110. Said shift gear 113, rotated by the drum gear 110, rotates the driven gear 141 of the development unit 104, thereby rotating rotary members such as the developing sleeve 141 in said development unit 104.

The present embodiment is provided with a detection mechanism for detecting whether the rotating force of the drum gear 110 is transmitted to desired one of the development units 104A–104D by the above-explained drive transmission switching means, and said detection mechanism enables the operator to immediately judge whether the rotating force of the drum gear 110 is transmitted to the development unit 104. Said detection mechanism will be explained in the following with reference to FIGS. 7 and 8.

Reflection members 130 are fixed, on the cartridge frame member 102*a*, respectively between the driven gears 141, 141 of the yellow and magenta development units 104A, 104B, and between the driven gears 141, 141 of the cyan and black development units 104C, 104D. Also sensors 131, each projecting light to said reflection member 130 and detecting the reflected light, are provided. On each driven gear 141 there is fixed a shield plate 132 which passes over the reflection member 130 with the rotation of said driven gear 141, thereby intercepting the light from the sensor 131 to the reflection member 130.

Figure 7:
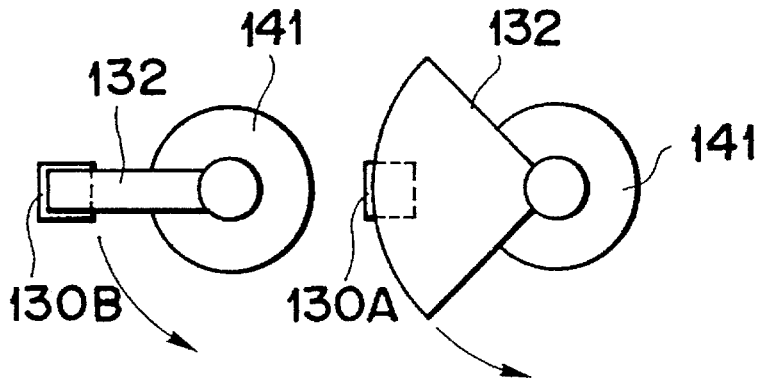
FIG. 7 is a plan view of detection means, for detecting the driven or undriven state of the developing unit, in an image forming apparatus embodying the present invention.
Figure 8:
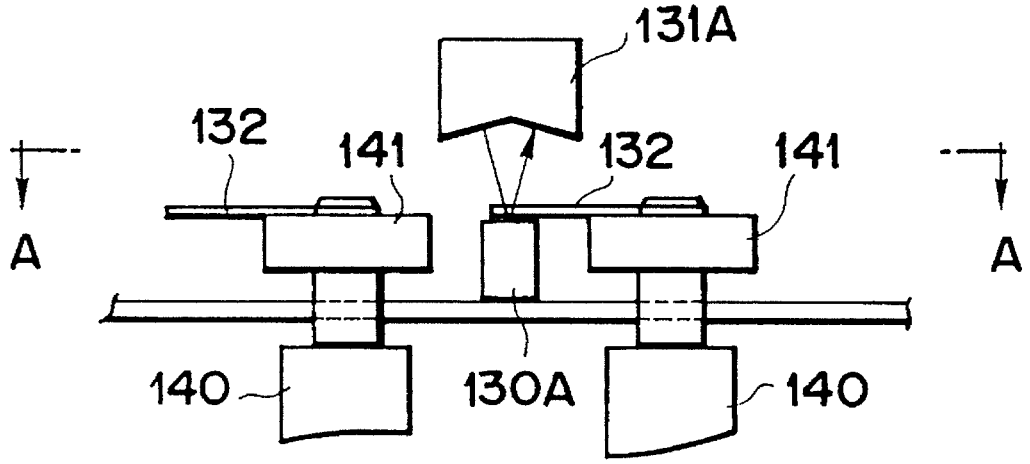
FIG. 8 is a view along a line A—A in FIG. 7.

The shield plates 132 for the different development units 104 are formed in different shapes, with different passing times over the reflection member 130. In the present embodiment, the intervals of the reflected light received by the sensors 131A, B from the reflection members 130A, B are made different for different development units, so that the sensors 131A, B can detect which development unit is selected and driven. More specifically, as shown in FIG. 7, a driven gear 141 bears a sector-shaped shield plate 132*a* while the other driven gear 141 bears a rectangular shield plate 132*b*. The shield plates 132 for the yellow and magenta development units 104A, 104B pass over a reflection member 130, while those 132 for the cyan and black development units 104C, 104D pass over the other reflection member 130. In the present embodiment, therefore, the drive state of four development units can be identified by two sensors 131A, 131B.

Thus, when the shift gear 113 of the selected development unit 104 is dropped, by the function of the development unit switching motor 120 in cooperation with the first and second gears 121, 122 and the cam gear 111, into the cam groove 112*a* of the cam member 112 and said shift gear is rotated by the drum gear 110, the driven gear 141 of said development unit 104 is also rotated, thereby causing the shield plate 132 to pass over the reflection member 130. Consequently the light emitted by the sensor 131 is turned into an on-off signal by said shield plate 132 and the reflection member 131, detected by said sensor 131 and transmitted to the control unit 100. Based on said signal from the sensor 131, the control unit 100 can indentify that the driven gear 141 of the selected development unit 104 is rotating properly and that the selected development unit 104 is selectively driven.

On the other hand, for example if the shift gear 113 of the selected development unit 104 is not properly positioned in the cam groove 112*a* of the cam member 112 and is not satisfactorily dropped into said cam groove 112*a*, said shift gear 113 is not rotated by the drum gear 110. Therefore the driven gear 141 of said development unit 104 is also not rotated. In such case, the sensor 131 continuously detect the light reflected from the reflection member 130, or, if the shield member 132 is positioned above the reflection member 130, the sensor is unable to detect the reflected light. In either case, the sensor does not repeat the on-off cycle at the predetermined interval, so that the control unit 100 can recognize that the desired development unit is not properly driven.

The control unit 100 of the main body 101 receives the signal from the sensors 131, and, in case the selected development unit 104 is not properly driven, the control unit 100 provides an alarm, whereby the operator can identify that the selected development unit is not properly working. In addition to said alarm, there may be conducted the discharge of the recording medium under image formation from the main body 101, or the repeated selective drive of the development unit 104, or the repeated image formation after the discharge of the recording medium, in order to expedite the succeeding sequence.

As explained in the foregoing, also in case of selecting one of plural development units 104 by mechanical drive transmission switching means, there is enabled to detect whether the development unit 104 is properly driven. Consequently, even when the development unit 104 is not driven properly by an erroneous function, the subsequent operation can be expedited so that the work efficiency can be improved. Also the apparatus can be compactized and reduced in manufacturing cost, since electric drive transmission switching means, such as solenoid clutches, can be dispensed with.

Figure 9:
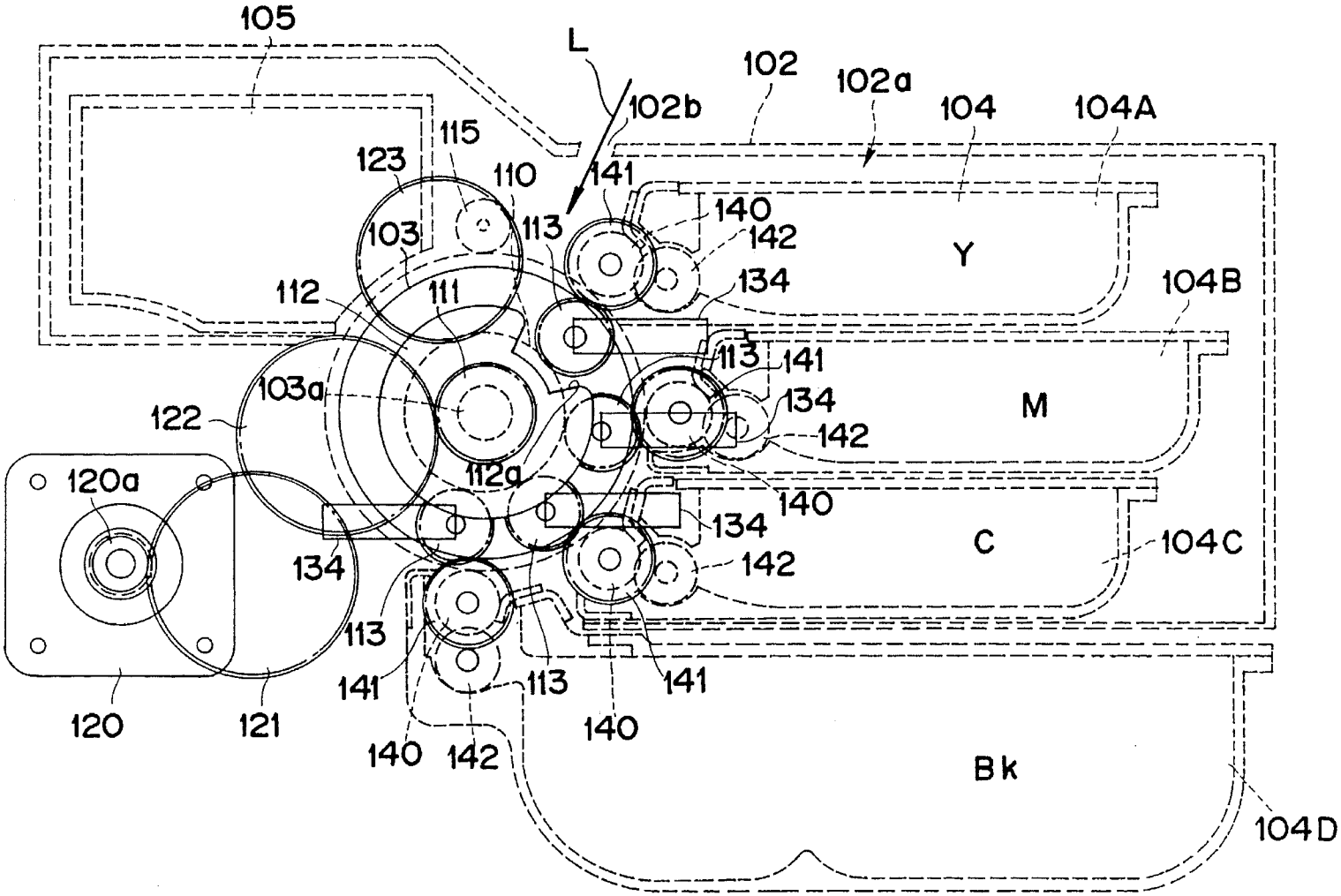
FIG. 9 is a lateral cross-sectional view of an image forming apparatus constituting an embodiment of the present invention.

In the following there will be explained another embodiment with reference to FIGS. 9 to 11, in which components equivalent in function to those in the foregoing embodiments are represented by same symbols and will not be explained further. In the present embodiment, the black development unit 104D is not incorporated in the process cartridge 102 but is independently detachably mounted in the main body of the apparatus.

In the present embodiment, the movement of the shift gear 113 is detected to identify whether the desired development unit 104 is selectively driven. For this purpose, an engaging member 133 is mounted on the protruding portion 113*a* of the shift gear 113, and a microswitch 134 is mounted on the main body 101 in opposed relationship to said engaging member 133, in such a manner that the engaging member 133 presses a detecting portion 134*a* of the microswitch 134 when the shift gear 113 is in the meshing position A, but is separated from said detecting portion 134*a* when the shift gear 113 is in the released position B. The engaging member 133 is provided, at the center thereof, with a penetrating hole 133*a*, through which the shaft 114 moves.

In the selection of the desired development unit 104 through the drive transmission switching means, the shift gear 113 of the desired development unit 104 is dropped into the cam groove 112*a* of the cam member 112, whereby said shift gear 113 moves from the released position B to the meshing position A and can drive the driven gear 141 of the development unit 104. Said development unit 104 is therefore selectively driven. At the same time the detecting portion 134*a* of the microswitch 134 is depressed by the engaging member 133 of the shift gear 113, whereby the selective drive of the development unit 104 can be detected. In case the shift gear 133 does not move from the released position B to the meshing position A, the engaging member 133 of the shift gear 113 remains separated from the detection portion 134*a* of the microswitch 134, which can therefore detect that the development unit 104 is not driven. The engaging member 133 depressed the detecting portion 134*a* through an aperture 102*b* formed on the frame member 102*a*.

The signals from the above-mentioned microswitches 134 are transmitted to the control unit 100 in the main body of the apparatus, and are similarly processed as in the foregoing embodiment. Consequently the present embodiment can provide similar advantages to those in the foregoing embodiment.

In the following there will be explained still another embodiment with reference to FIGS. 12 to 14, in which components equivalent in function to those in the foregoing embodiments are represented by same symbols and will not be explained further.

In contrast to the foregoing embodiments in which a single motor is used for selecting and driving the development units and for driving the photosensitive drum, in the embodiment to be explained in the following, a motor 120 is used for selecting the development units while another motor M2 is used for driving the development units and the photosensitive drum.

More specifically, in the present embodiment, there is provided a current detector 160 for detecting the current in the motor M2 for rotating the gear 123 of the drive transmission switching means, and the magnitude of thus detected current is used for identifying whether a desired development unit 104 is selectively driven.

The load current in the motor M2 is smaller when it drives the drum gear 110 only through the driving gear 123, but said current becomes larger when said motor drives also the developing sleeve of the development unit 104 through the drum gear 110 and the gears 113, 141. It is therefore possible to immediately identify whether the desired development unit 104 is driven, by detecting said current with the current detector 160 and transmitting the result of said detection to the control unit 100. In particular, the present embodiment has an advantage that the sensors need not be provided on the respective development units 104.

The signal from said current detector is transmitted to the control unit 100 of the main body of the apparatus and is processed in a similar manner as in the foregoing embodiments. Consequently the present embodiment can provide advantages similar to those in the foregoing embodiments.

In the following there will be explained still embodiment with reference to FIGS. 12 to 14, in which components equivalent in function to those in the foregoing embodiments are represented by same symbols and will not be explained further.

Also in this embodiment there is provided a current detector 170, for detecting the current between the photosensitive drum 103 and the developing sleeve 140 of the development unit 104. When a current is generated at the image development between the photosensitive drum 104 and the developing sleeve 140 of a desired development unit 104, said current detector 170 identifies that the desired development unit 104 is selectively driven, and, in the absence of said current, there is detected that the desired development unit 104 is not driven.

The toner in the development unit 104 is supported, with a certain charge, on the developing sleeve 140, and moves to the photosensitive drum 103, at the image development, by application of a developing bias voltage to said developing sleeve 140. Said movement of toner with a charge induces a current between the photosensitive drum 103 and the developing sleeve 140. Consequently, if the desired development unit 104 is driven and the developing sleeve 140 is rotated, a continuous current is generated between said developing sleeve 140 and the photosensitive drum 103, so that the selective drive state of said development unit 104 can be detected by said current detector.

The signal from said current detector is transmitted to the control unit 100 of the main body of the apparatus and is processed in a similar manner as in the foregoing embodiments. Consequently the present embodiment can provide advantages similar to those in the foregoing embodiments.

In the above-explained embodiments, the driven or undriven state of the driven member in the development means selected by the drive transmission switching means is detected by detection means, whereby the operator can immediately recognize whether the desired development means is selectively driven, and, if it is not driven, can immediately take appropriate action therefor, thereby improving the efficiency of the operations. Also the drive transmission switching means can be made compact and inexpensive, as it is mechanically constructed.

In the following there will be explained a laser beam printer, as an example of the image forming apparatus in which the foregoing embodiments are applicable. Said example is constructed with a process cartridge, but the present invention is naturally applicable to other configurations, for example a configuration in which the photosensitive drum and the respective development units are individually mounted in and detached from the apparatus.

FIG. 15 is a cross-sectional view, showing principal components of a laser beam printer, as an example of the image forming apparatus capable of producing a full-color image.

A process cartridge 102, detachably mounted in a main body 1 (101) of the apparatus, is provided at a side thereof with a transfer drum 230 capable of rotation with a recording sheet (recording medium) thereon. Above said process cartridge there is provided an optical unit 233 for emitting image light L, corresponding to yellow, magenta, cyan and black images, toward said process cartridge 102. At the sheet feeding side of the transfer drum 230, there is loaded, in detachable manner in a loading portion 241, a sheet cassette 231 for feeding the recording sheet to said transfer drum 230. Also at the sheet discharge side of the transfer drum 230, there is provided a fixing unit 232, including a heating roller 232*a* and a pressure roller 232*b* and adapted for processing the recording sheet, after the image transfer, thereby fixing the toner images thereon as a permanent image.

In the following there will be explained the operations for forming a full-color image.

At first the process cartridge 102 is inserted between loading means 240*a*, 240*b* in the main body 1 (101), and a lever 240*c* is pulled whereby the cartridge 102 is lifted upwards and mounted in a predetermined position. Then the following operations are executed in response to signals from an operation unit 100. At first a feed roller 243 starts to rotate, thereby advancing a recording sheet (recording medium) P such as a recording paper, an OHP sheet or a cloth, from a feeding unit 231.

Figure 17:
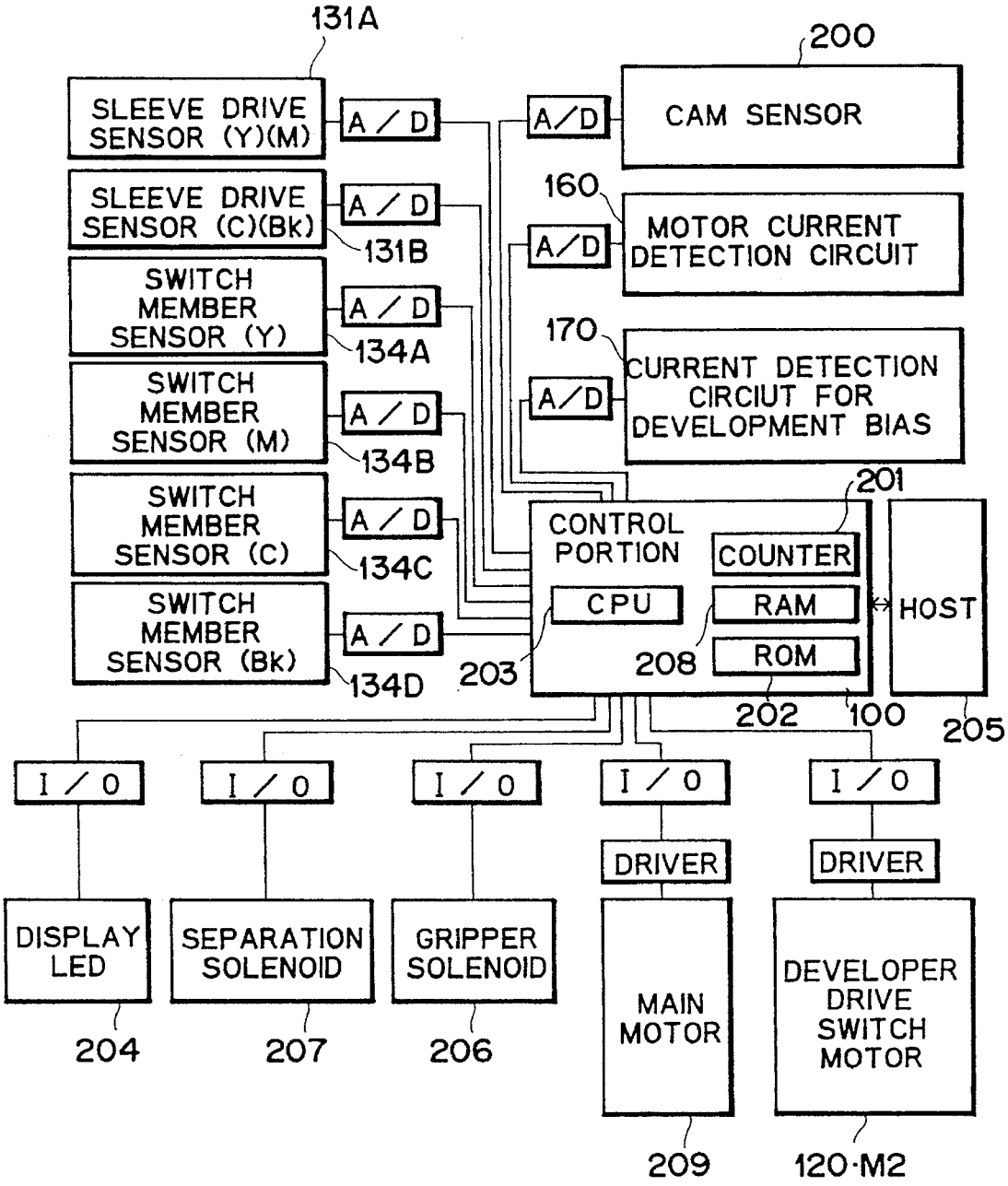
FIG. 17 is a block diagram of an embodiment of the present invention.

On the other hand, a photosensitive drum 30 (103) is charged by a charging roller 115, and is exposed to a laser beam coming from the optical unit 233 and modulated according to image information, whereby a latent image corresponding to said image information is formed. Subsequently said latent image is developed into yellow color with a yellow development unit 104A. On the other hand, the recording sheet P is fed to a transfer position by registration rollers 244, in synchronization with said image development, and the image developed on the photosensitive drum 30 (103) is transferred onto said recording sheet P, by the function of a transfer charger 180. The recording sheet P is supported by a gripper (not shown) on the periphery of the transfer drum 230, and is subjected to the transfer of developed images formed on the photosensitive drum 30 (103) in succession in the above-explained procedure, in respective turns of the transfer drum 230. After the transfer of developed images of four colors, the recording sheet P is released from the gripper (not shown) and is separated, by the function of separating fingers (not shown), from the periphery of the transfer drum 230, and is advanced to the fixing unit 232. After the fixation of the developed images in said fixing unit 232, the recording sheet P is discharged by discharge rollers 245 onto a discharge tray 242. Said gripper and said separating fingers are operated respectively by a gripper solenoid 206 and a separating solenoid 207 (FIG. 17).

In the following there will be explained the control sequence and the block configuration of an embodiment of the present invention, with reference to FIGS. 16 and 17.

Figure 16:
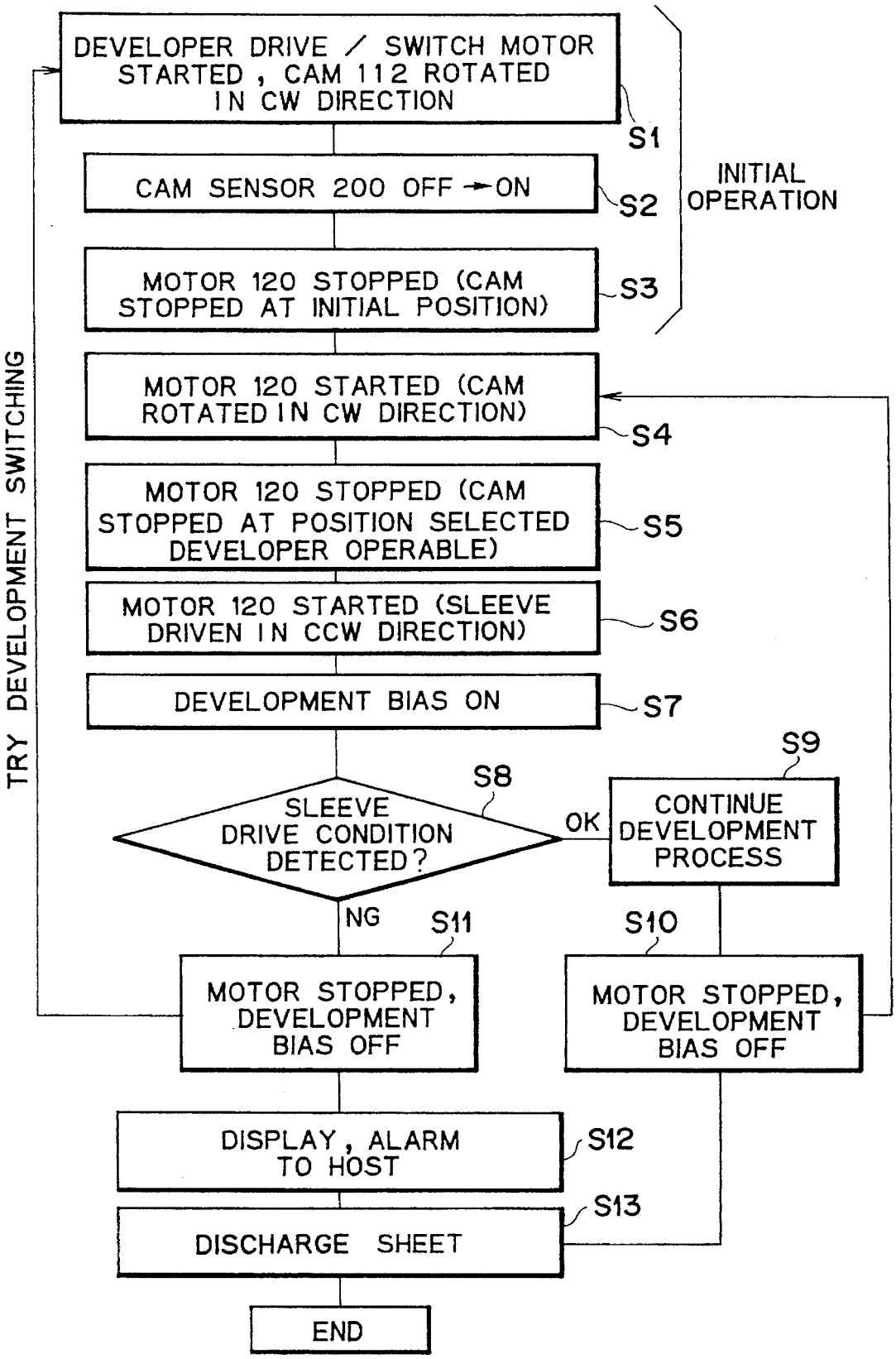
FIG. 16 is a flow chart of the control sequence of an embodiment of the present invention.

At first reference is made to FIG. 16 for explaining the control sequence.

The selection of the development unit to be driven is conducted by the control of stopping position of the cam member 112. For this purpose, a cam initializing operation is executed to bring the phase of the cam 112 to a predetermined initial position. More specifically, a development unit drive/switch motor M is rotated in a direction for operating the cam 112 (clockwise (CM) direction in the present embodiment) (step S1), and the cam (motor) is stopped when the cam 112 is rotated by a predetermined angle after a cam sensor 200 is shifted from off state to on state (steps S2, S3). The motor 120 is composed of a stepping motor, and the stopping position of the cam 112 or the motor 120 is controlled by counting a predetermined number of steps with a counter 201.

The developing operation is conducted in the following manner.

At first the cam 112 is rotated to and stopped at a position where the sleeve 141 of the development unit 104A of the first color can be driven (steps S4, S5). Said stopping position of the cam 112 is controlled by a CPU 203, based on the angles between the initial cam position and the sleeve driving positions of the development units and the angles among said sleeve driving positions, stored in a ROM 202.

Then the development unit drive/switch motor 120 is rotated in a direction for driving the sleeve 141 (counter-clockwise (CCW) direction in the present embodiment) (step S6), and a developing bias voltage is applied between the image bearing member 103 and the selected sleeve 141 (step S7). In this embodiment, there is checked, at this state, whether the selected sleeve 141 is properly driven (step S8). The proper drive of the selected sleeve can be detected, as explained in the foregoing embodiments, by (1) direction detection of the rotation of the sleeve by a sensor attached to each sleeve, (2) detection of proper switching of the switching member by a sensor attached to each switching member, (3) detection of change in current resulting from a load for sleeve drive, through detection of current of the sleeve driving motor, or (4) detection of change in current resulting from sleeve rotation, through detection of the developing bias current.

These detecting methods will be explained further in the following. The method (1) was already explained in relation to FIGS. 7 and 8. In the present embodiments, sleeve drive sensors 131A–131D are provided respectively on the development units, and the ROM stores in advance the on-off interval of the sensor 131A or 131B when each developing sleeve is properly driven. The control unit 100 compares the on-off interval of the signal from the sensor 131A or 131B with the interval stored in the ROM 202, and identifies a defective drive state in case of non-coincidence. Said defective drive state is identified, for example, if the reflected light is continuously detected or is not detected with a predetermined timing.

The method (2) was explained already in relation to FIGS. 10 and 11. In this case the switching member sensors 134A–134D are provided respectively on the development units, and each of said sensors can be turned on only when the drive transmission switching means functions properly, based on the aforementioned configuration. When one of said sensors 134A–134D is turned on, the control unit 100 can identify that the development unit corresponding to the turned-on sensor is enabled for driving.

Figure 12:
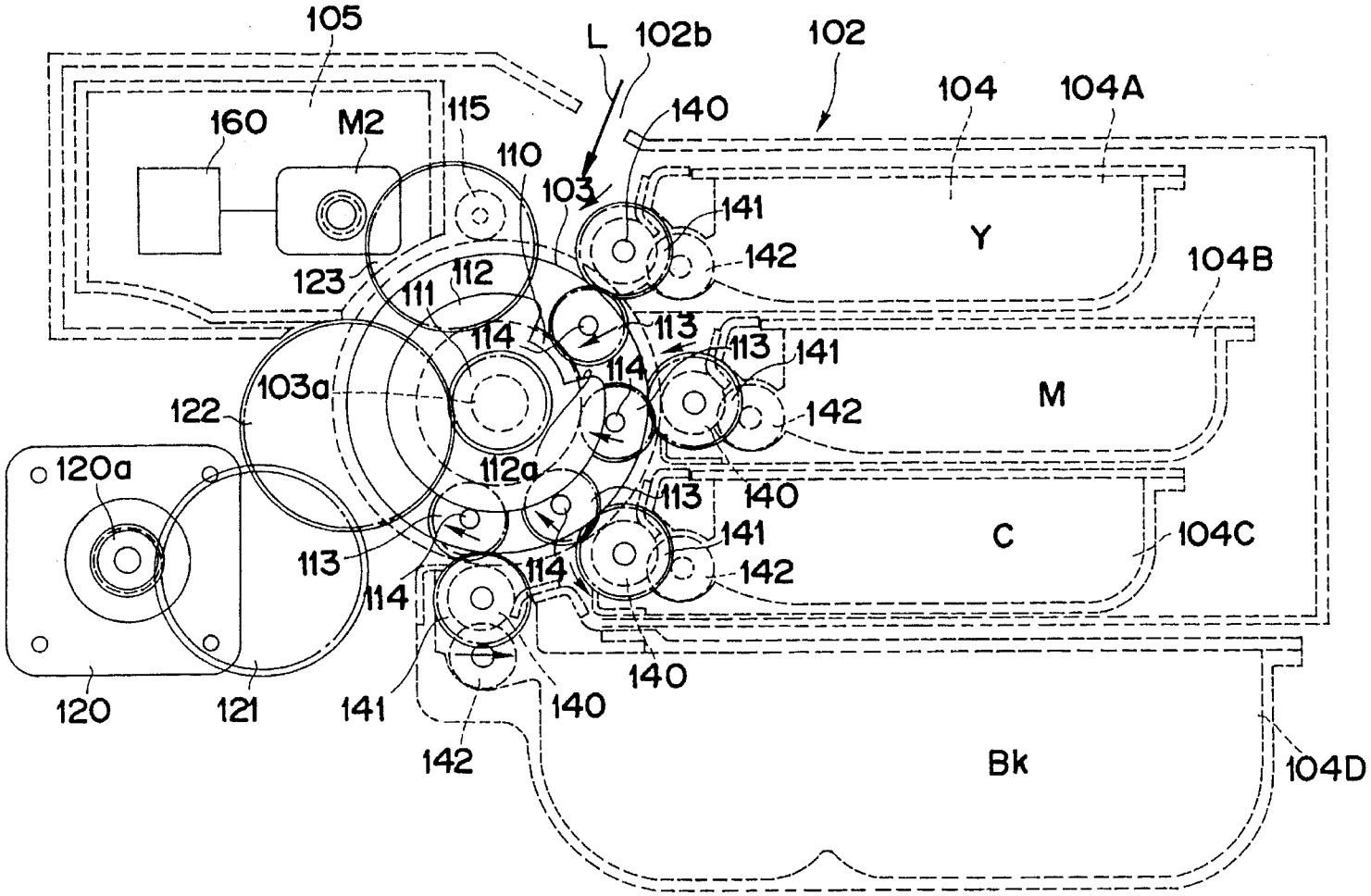
FIG. 12 is a lateral view of a drive transmission switching mechanism around a photosensitive drum in an image forming apparatus constituting another embodiment of the present invention.
Figure 13:
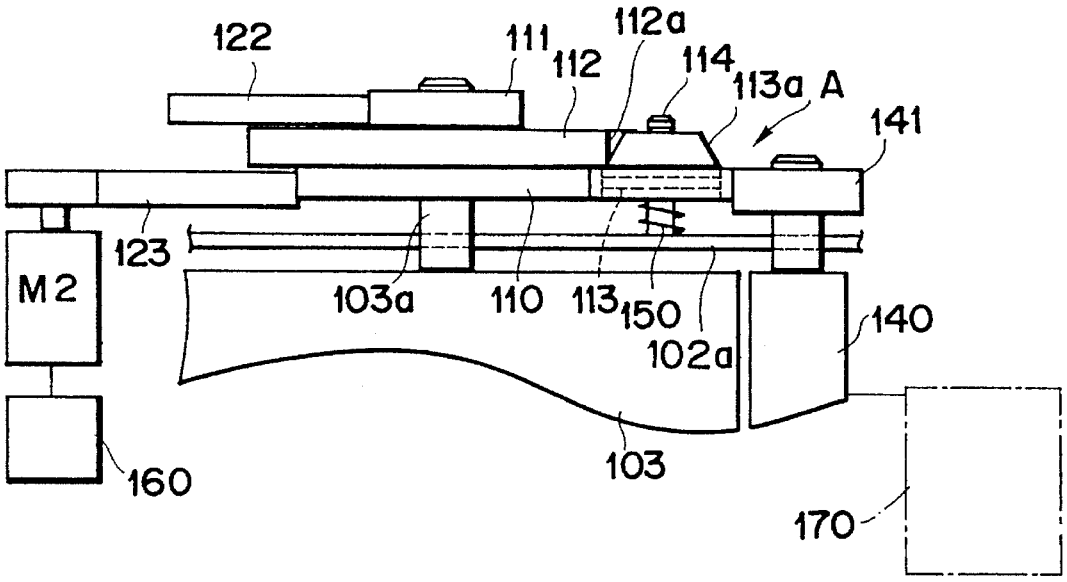
FIGS. 13 and 14 are lateral views showing the function of a shift gear in an image forming apparatus constituting another embodiment of the present invention.
Figure 14:
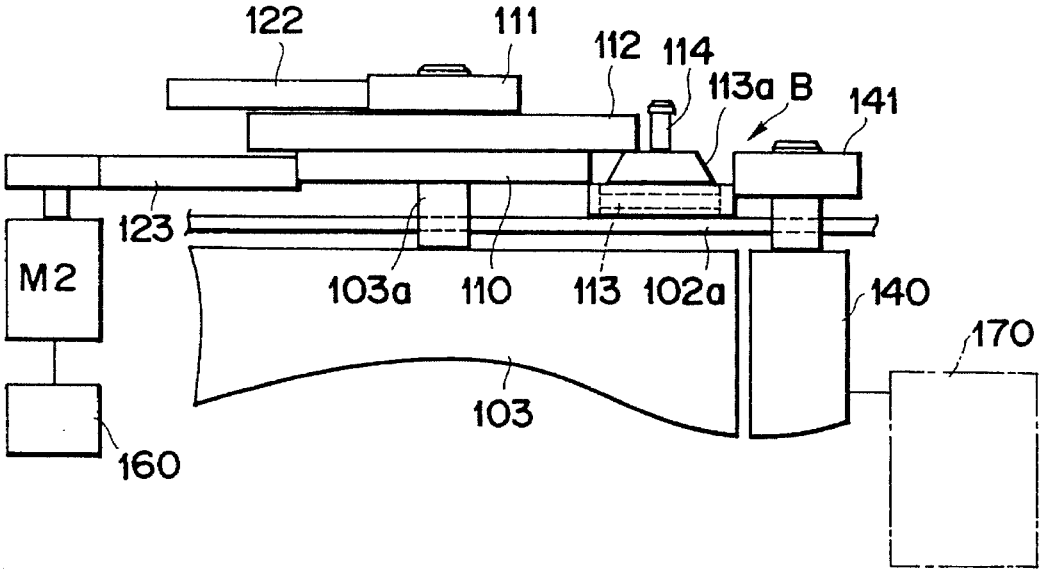

The method (3) was explained already in relation to FIGS. 12 to 14. In this case, the control unit 100 can distinguish, through comparison of the current detected by the motor current detection circuit 160 with a current stored in advance in the ROM 202, a case of defective drive in which the photosensitive drum alone is driven but the selective developing sleeve is not driven, from a case of proper drive in which both are driven. Naturally there can be detected a case of defective drive in which both the photosensitive drum and the developing sleeve are not driven.

The method (4) was also explained in relation to FIGS. 12 to 14. In this case the control unit 100 can identify whether the selected developing sleeve is properly driven, by the comparison of the current detected by the developing bias current detecting circuit 170 with the current memorized in advance in the ROM 202.

In case the developing sleeve is identified to be properly driven by any of the foregoing methods, the development process is continued (step S9), and, after the end of development, the motor 120 (M2) is stopped and the developing bias voltage is turned off (step S10). Then the above-explained process is repeated for the necessary number of colors. After the development is completed for the necessary colors, the recording sheet P is discharged onto the discharge sheet tray 242 (step S13).

On the other hand, if the developing sleeve is identified to be not properly driven, the motor 120 (M2) is stopped and the developing bias voltage is turned off (step S11). Then a display LED 204 is made to flicker as an alarm, and an alarm signal is sent to a host apparatus 205 (step S12).

The cam initialization and the selection/drive of the development unit may be executed again from the state shown in the step S11 (development/switch retry).

As a recording sheet P in the course of recording is still present in the apparatus, it is separated from the transfer drum 230 at the separating position (by releasing the gripper, turning on the separating charger and activating the separating fingers), and is discharged after fixation (step S13).

Thereafter the erred image formation may be automatically repeated from the beginning, or the sequence may enter a state awaiting a next instruction.

In the following there will be explained the entire configuration, with reference to a block diagram shown in FIG. 17.

A control unit 100, for controlling the entire apparatus, is provided with a CPU 203 which is composed for example of a microprocessor and executes control of operation such as recording, by releasing various signals through I/O ports and processing signals entered through an A/D converter, according to a control program corresponding to the flow chart shown in FIG. 16 and stored in a ROM 202. A RAM 208 is used as a work area for the CPU 203 and for temporary storage of various data. The above-mentioned control unit 100 receives control information from a host apparatus 205 such as a computer or a word processor. A main motor 209 is provided for driving the recording sheet transport means etc. It is to be understood that the present block diagram illustrates all the components required in the foregoing embodiments, and that all these components need not be provided in practice.

The present invention need not necessarily be applied to an image forming apparatus utilizing a process cartridge, but, in case such process cartridge is employed, it is not limited to that described in the foregoing embodiments but may include at least an image bearing member and plural development means. It may further integrally include process means acting on the image bearing member, such as charging means, cleaning means or a lens.

In the multi-color image forming apparatus explained above, a color image is obtained by overlaying images on a recording material by repeating, plural times, a process of latent image formation on an image bearing member, image development and image transfer onto a recording material. However it is also possible to employ a method of forming overlaid images on an intermediate transfer member by repeating, plural times, a process of latent image formation on an image bearing member, image development and image transfer onto the intermediate transfer member, and transferring said overlaid images collectively onto the recording material, or a method of effecting latent image formation and image development plural times on an image bearing member to obtain overlaid images on said image bearing member, and collectively transferring said overlaid images onto the recording material.

The formation of a multi-color image includes so-called full-color image formation and formation of so-called multi-color (two-color or three-color for example) image, by formation of plural monochromatic images.

As explained in the foregoing, the present invention can provide an image forming apparatus capable of exactly transmitting the driving force to development means selected from plural development means, with a smaller space than in the conventional technology.

Also the present invention can provide an image forming apparatus which enables the operator to promptly recognize the defective drive state of the apparatus.

What is claimed is:

1. An image forming apparatus for forming an image on a recording medium, comprising:

an image bearing member;

plural development means for effecting image development by acting on said image bearing member; and drive means for enabling drive force transmission to a selected one of said plural development means by rotation in a first direction, and driving said selected development means by rotation in a second direction opposite to the first direction, wherein said image bearing member is an electrophotographic photosensitive member, and said electrophotographic photosensitive member and said plural development means are integrally formed as a process cartridge which is detachably loaded in the main body of the image forming apparatus.

2. An image forming apparatus according to claim 1, wherein said process cartridge further includes at least either of charging means and cleaning means for acting on said electrophotographic photosensitive member.

3. An image forming apparatus for forming an image on a recording medium, comprising:

an image bearing member;

plural development means for effecting image development by acting on said image bearing member; and drive means for enabling drive force transmission to a selected one of said plural development means by rotation in a first direction, and driving said selected development means by rotation in a second direction opposite to the first direction;

wherein said image bearing member and development means for yellow, magenta and cyan colors, among said plural development means, are integrally formed as a process cartridge which is detachably mounted in the main body of the image forming apparatus.

4. An image forming apparatus for forming an image on a recording medium, comprising:

an image bearing member;

plural development means for effecting image development by acting on said image bearing member;

a driving source; and switch means for connecting a drive transmission path between the selected one of said plural development means and said driving source in order to transmit the driving force from said driving source;

wherein the driving force of said driving source serves to drive said switch means and said development means; and wherein said image bearing member is an electrophotographic photosensitive member, and said electrophotographic photosensitive member and said plural development means are integrally formed as a process cartridge which is detachably loaded in the main body of the image forming apparatus.

5. An image forming apparatus according to claim 4, wherein said process cartridge further includes at least either of charging means and cleaning means for acting on said electrophotographic photosensitive member.

6. An image forming apparatus for forming an image on a recording medium, comprising:

an image bearing member;

plural development means for effecting image development by acting on said image bearing member;

a driving source; and switch means for connecting a drive transmission path between the selected one of said plural development means and said driving source, in order to transmit the driving force from said driving source;

wherein the driving force of said driving source serves to drive said switch means and said development means; and wherein said image bearing member and development means for yellow, magenta and cyan colors, among said plural development means, are integrally formed as a process cartridge which is detachably loaded in the main body of the image forming apparatus.

7. An image forming apparatus for forming an image on a recording medium, comprising:

an image bearing member;

plural development means for effecting image development by acting on said image bearing member;

a driving source;

switching means for connecting a drive transmission path between selected one among said plural development means and said driving source; and discrimination means for discriminating defective connection in the drive transmission path between said selected development means and said driving source.

8. An image forming-apparatus according to claim 7, wherein said discrimination means is adapted to discriminate defective connection by directly detecting the presence or absence of rotation of a developing sleeve by a developing sleeve drive sensor.

9. An image forming apparatus according to claim 7, wherein said discrimination means is adapted to discriminate defective connection by detecting, with a switch member sensor, that a switch member of said switch means is not switched to a proper position.

10. An image forming apparatus according to claim 7, wherein said discrimination means is adapted to discriminate defective connection by detecting the current in a motor for driving the developing sleeve.

11. An image forming apparatus according to claim 7, wherein said discrimination means is adapted to discriminate defective connection by detecting a development bias current.

12. An image forming apparatus according to claim 7, wherein said image bearing member is an electrophotographic photosensitive member, and said electrophotographic photosensitive member and said development means are integrally formed as a process cartridge which is detachably loaded in the main body of the image forming apparatus.

13. An image forming apparatus according to claim 12, wherein said process cartridge further includes at least either of charging means and cleaning means for acting on said electrophotographic photosensitive member.

14. An image forming apparatus according to claim 7, wherein said development means includes a developing sleeve for transporting developer to a development position, and said developing sleeve is rotated by the driving force received from a driving source in the main body of the apparatus.

15. An image forming apparatus according to claim 7, wherein said image bearing member and development means for yellow, magenta and cyan colors, among said plural development means, are integrally formed as a process cartridge which is detachably loaded in the main body of the image forming apparatus.

16. An image forming apparatus, comprising:

an image bearing member;

plural developing means for supplying developing agent to said image bearing member, each of said plural developing means having a developing agent bearing member;

a drive source for supplying a driving force for driving said plural developing agent bearing members;

drive force transmitting means for transmitting the driving force to one of said plural developing agent bearing members; and switch means for switching which of said plural developing agent bearing members is to be driven by said drive force transmitting means;

wherein said switch means is adapted to be driven by the drive force when the drive force is not transmitted from said drive source to said plural developing agent bearing members.

17. An image forming apparatus according to claim 16, further comprising controlling means for generating a control signal to control when the drive force is not transmitted.

18. A multi-color image forming apparatus provided with a process cartridge which includes at least an image bearing member and plural development means and is detachably loaded in the main body of said apparatus, and driving force transmission switching means for mechanically switching the development means used for image development by the switching of transmission of driving force to the development means in said process cartridge, comprising:

detection means for detecting the driven or undriven state of a driven member of the development means by said drive force transmission switching means.

19. A multi-color image forming apparatus according to claim 18, wherein said detection means is adapted to detect the driven or undriven state of said driven member of the development means, through a function, caused by the drive force transmission switching means, of a power transmission member provided in each development means, or of a driven member of said development means.

20. A multi-color image forming apparatus according to claim 18, wherein said detection means is adapted to detect the driven or undriven state of said driven member of the development means, through a change, induced by said drive force transmission switching means, in a load current of a development means driving motor.

21. A multi-color image forming apparatus according to claim 18, wherein said detection means is adapted to detect the driven or undriven state of said driven member of the development means, through a change in the current between the image bearing member and a developer bearing member of the development means.

22. A multi-color image forming apparatus according to one of claims 18, 19, 20 or 21, further comprising control means for effecting, in response to a signal from said detection means and in case the driven member of the development means is not driven, discharge of a recording material, an alarm display, reswitching of the development means, or discharge of recording material and repeated image formation.

* * * * *

UNITED STATES PATENT AND TRADEMARK OFFICE

CERTIFICATE OF CORRECTION

PATENT NO. : 5,495,327

DATED : February 27, 1996

INVENTOR(S) : Mitsugu Inomata

It is certified that error appears in the above-identified patent and that said Letters Patent is hereby corrected as shown below:

Title page:

[56], "4731182 3/1992 European Pat. Off." should read --473182 3/1992 European Pat. Off.--.

COLUMN 7:

Line 63, "detect" should read --detects--.

COLUMN 8:

Line 16, "there is enabled" should read --it is possible--.

UNITED STATES PATENT AND TRADEMARK OFFICE

CERTIFICATE OF CORRECTION

PATENT NO. : 5,495,327

DATED : February 27, 1996

INVENTOR(S) : Mitsugu Inomata

It is certified that error appears in the above-identified patent and that said Letters Patent is hereby corrected as shown below:

COLUMN 9:

Line 38, "still embodiment" should read --still another embodiment--.

Signed and Sealed this

Twenty-fourth Day of September, 1996

*Attest:*

Bruce Lehman

BRUCE LEHMAN

*Attesting Officer*

*Commissioner of Patents and Trademarks*